US006463980B1

(12) United States Patent
Huang

(10) Patent No.: US 6,463,980 B1
(45) Date of Patent: Oct. 15, 2002

(54) SHIELD OF CUTTER OF ADHESIVE TAPE DISPENSER

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 106 days.

(21) Appl. No.: 09/661,300

(22) Filed: Sep. 13, 2000

(51) Int. Cl.[7] ..... B26F 3/02

(52) U.S. Cl. ..... 156/527; 156/577; 156/579; 225/19; 225/20

(58) Field of Search ..... 156/574, 577, 156/579, 523, 527; 225/20, 19, 91, 56, 77

(56) References Cited

U.S. PATENT DOCUMENTS 5,022,576 A * 6/1991 Jenq ..... 225/20

5,456,790 A 10/1995 Chen

* cited by examiner

*Primary Examiner*—Curtis Mayes
*Assistant Examiner*—Cheryl N. Hawkins
(74) *Attorney, Agent, or Firm*—Browdy and Neimark, P.L.L.C.

(57) ABSTRACT

A cutter shield of an adhesive tape dispenser comprises a carrying seat and a cover. The carrying seat is provided with two longitudinal holes for fastening the carrying seat over the cutter of the adhesive tape dispenser by bolts which are received in the longitudinal holes. The carrying seat is provided in one side with two upright plates which are provided with two locating holes. The cover is pivoted with the carrying seat and is provided in one side with an arcuate tongue and a curved guard extending therefrom at an angle. The cover is provided in other side with two recesses and a flat portion which is provided in two ends thereof with a projection. The projection is retained in the locating hole of the carrying seat.

8 Claims, 7 Drawing Sheets

SHIELD OF CUTTER OF ADHESIVE TAPE DISPENSER

FIELD OF THE INVENTION

The present invention relates generally to an adhesive tape dispenser, and more particularly to a safety cover of the cutter of the adhesive tape dispenser.

BACKGROUND OF THE INVENTION

The U.S. Pat. No. 5,456,790 discloses a protective cover of the cutter of an adhesive tape dispenser, which comprises a clapper formed of a vertical plate and a horizontal plate, and a cover. The horizontal plate is provided with two pivoting lugs. The cover is provided with two retaining lugs, which are pivoted with the pivoting lugs. The cover is further provided with a locating block which presses against the horizontal plate at the time when the cover is lifted. The locating block presses against the vertical plate at the time when the cover is located at the covering position to shield the cutter.

Such a prior art cutter shield as described above is defective in design in that it is not cost-effective in light of an additional cost of a new molding tool for making the lugged plates. In addition, the prior art cutter shield is not compatible with the adhesive tape dispensers devoid of a clapper formed of the vertical plate and the horizontal plate.

SUMMARY OF THE INVENTION

The primary objective of the present invention is to provide an adhesive tape dispenser with a cutter shield which is simple in construction and compatible with a variety of adhesive tape dispensers.

The cutter shield of the present invention comprises a carrying seat and a cover pivoted with the carrying seat which is mounted over the cutter of an adhesive tape dispenser or stand. The cover can be swiveled between a covering position and an uncovering position.

The features and the advantages of the present invention will be more readily understood upon a thoughtful deliberation of the following detailed description of the present invention with reference to the accompanying drawings.

DETAILED DESCRIPTION OF THE INVENTION

Figure 1:
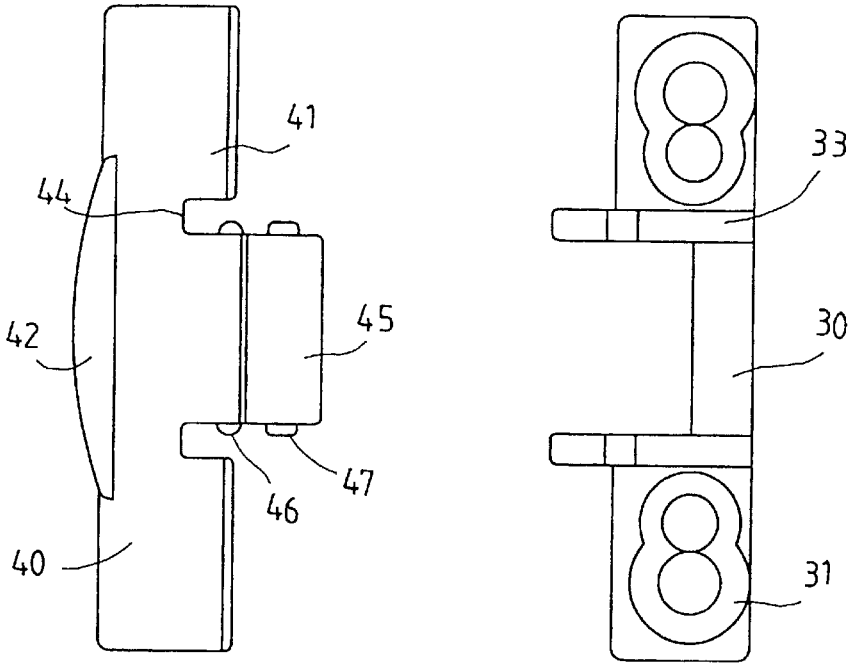
FIG. 1 shows an exploded view of a first preferred embodiment of the present invention.
Figure 2:
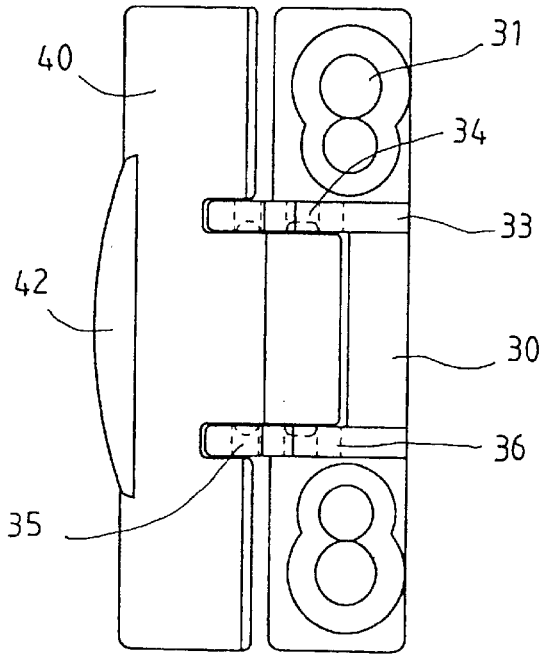
FIG. 2 shows a perspective view of the first preferred embodiment of the present invention in combination.
Figure 3:
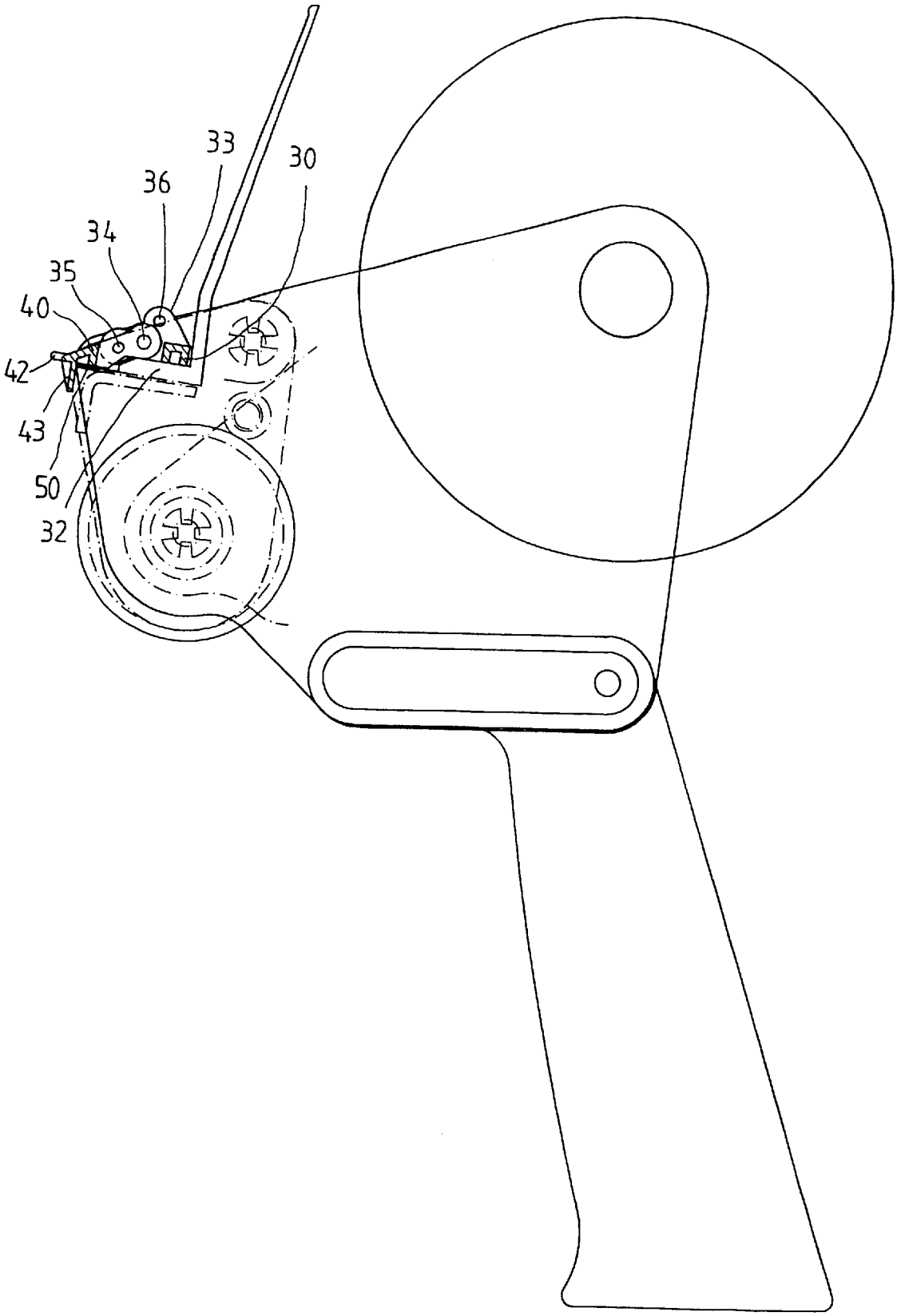
FIG. 3 shows a side sectional view of the first preferred embodiment of the present invention mounted on an adhesive tape dispenser.

As shown in FIGS. 1–3, a cutter shield of the first preferred embodiment of the present invention is used along with an adhesive tape dispenser and is formed of a carrying seat 30 and a cover 40.

The carrying seat 30 is provided with two long holes 31 extending in the direction of a longitudinal axis of the carrying seat 30. The two long holes 31 are intended to facilitate the mounting of the carrying seat 30 over the cutter of an adhesive tape dispenser or stand. In order to conform to the market specification, the two long holes 31 are in communication with each other and are different from each other in hole diameter. The carrying seat 30 is mounted over a cutter and a clapper 32 by two bolts which are received in the two long holes. The carrying seat is provided in a longitudinal side with two upright plates 33 which are opposite to each other and arranged at an interval. The upright plates 33 are provided with a pivoting portion, which is an axial hole 34. Each upright plate is further provided with two locating portions, which are a first locating hole 35 and a second locating hole 36. These two locating holes 35 and 36 are located on the circumference of a circle with the axial hole 34 as a center of the circle.

The cover 40 has a body 41 which is provided in one longitudinal edge thereof with an arcuate tongue 42 and a curved guard 43 extending outward at an angle from the body 41. The body 41 is provided in other longitudinal edge thereof with two recesses 44 and a flat portion 45 projecting therefrom and having two locating portions 46 and two pivoting portions 47.

Figure 4:
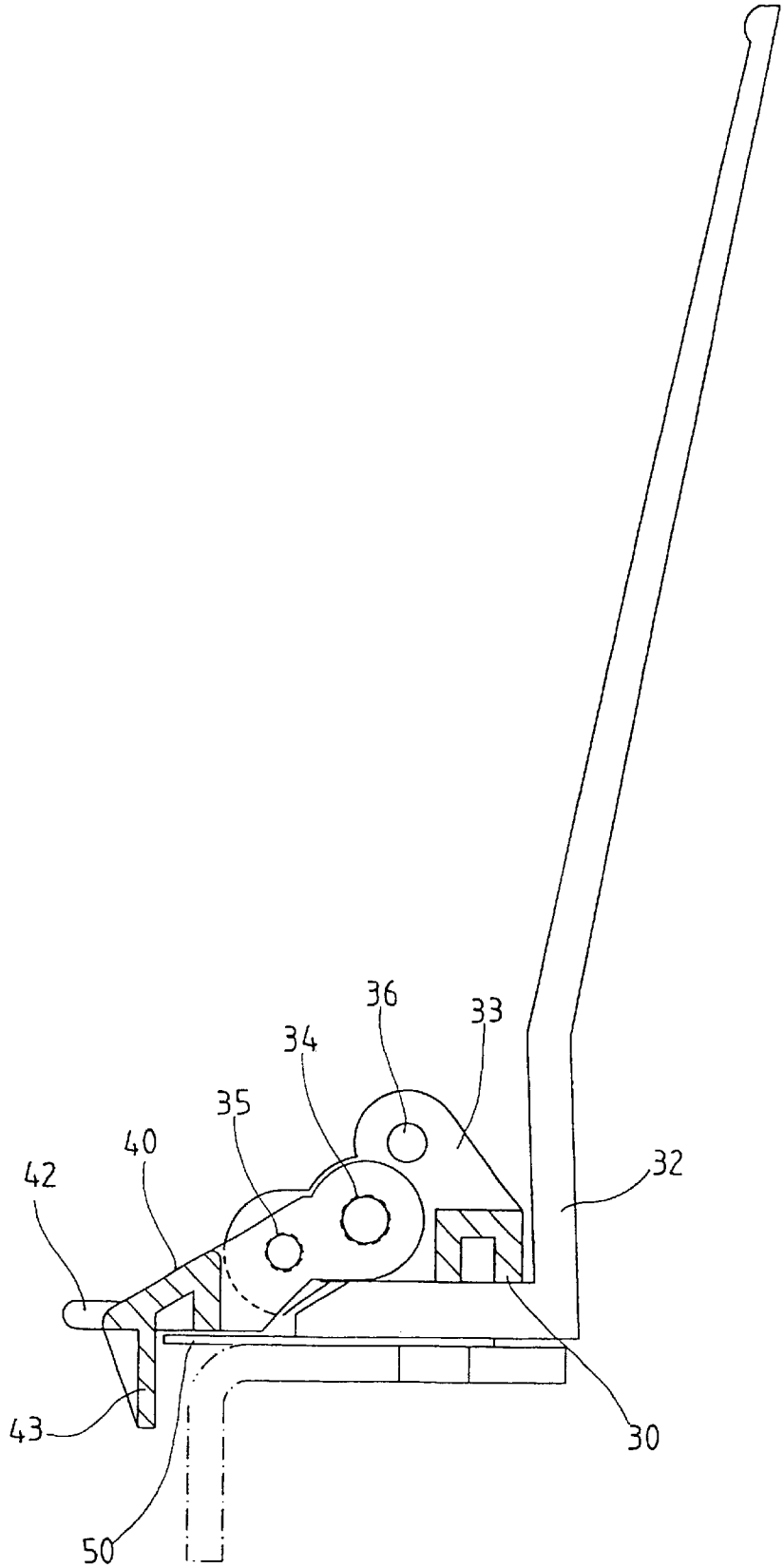
FIG. 4 shows a schematic view of the first preferred embodiment of the present invention in the covering position.

As shown in FIGS. 2 and 3, the two pivoting portions (pivots) 47 of the cover 40 are disposed in the two axial holes 34 of the carrying seat 30, so as to enable the cover 40 to turn on the pivots 47 such that the locating portions 46 are retained in the first locating hole 35. The carrying seat 30 is mounted over the cutter 50 of an adhesive tape dispenser or stand by bolts. As the locating portions 46 are located in the first locating hole 35, the cover is located at the covering position such that the cutter 50 is shielded by the guard 43, as shown in FIG. 4.

Figure 5:
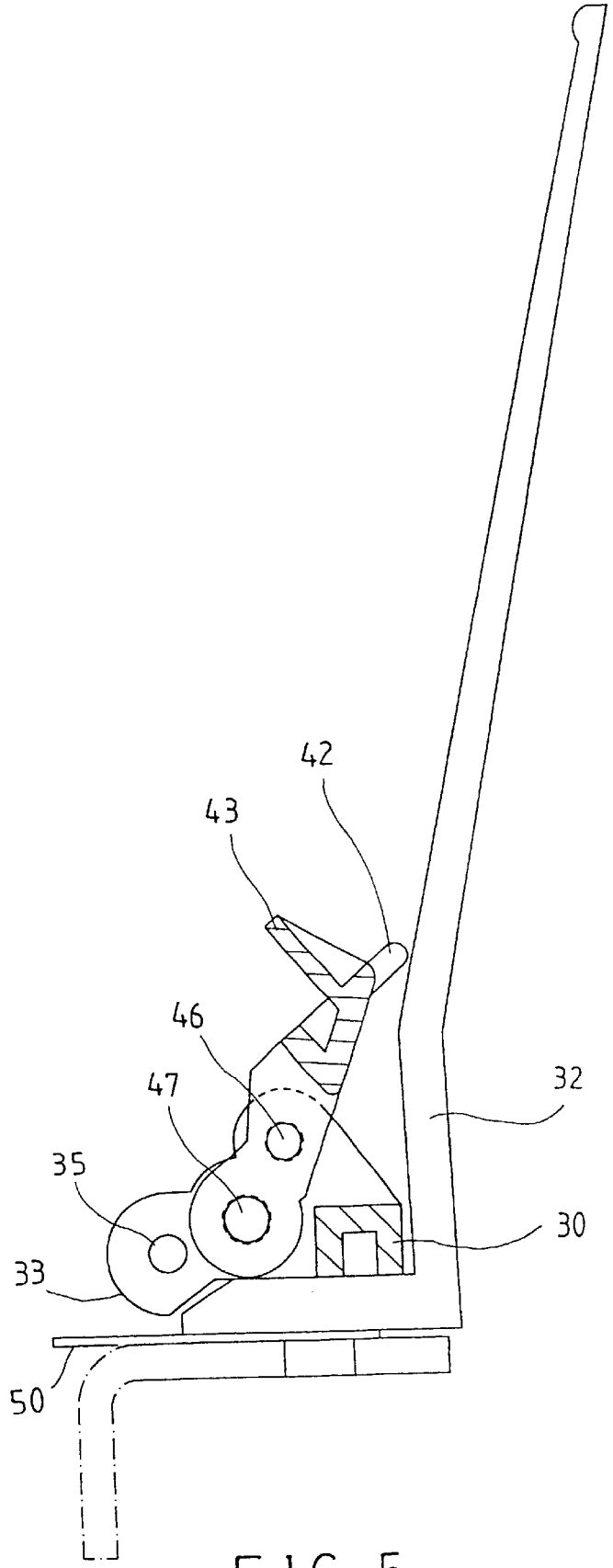
FIG. 5 shows a schematic view of the first preferred embodiment of the present invention in the uncovering position.

Before the dispenser is used, the tongue 42 is moved with finger to lift the cover 40 such that the locating portions 46 are located in the second locating hole 36 of the carrying seat, and that the cutter is not shielded. In light of the cover and the carrying seat 30 forming an angle, the cover does not obstruct the dispensing action, as shown in FIG. 5.

Figure 6:
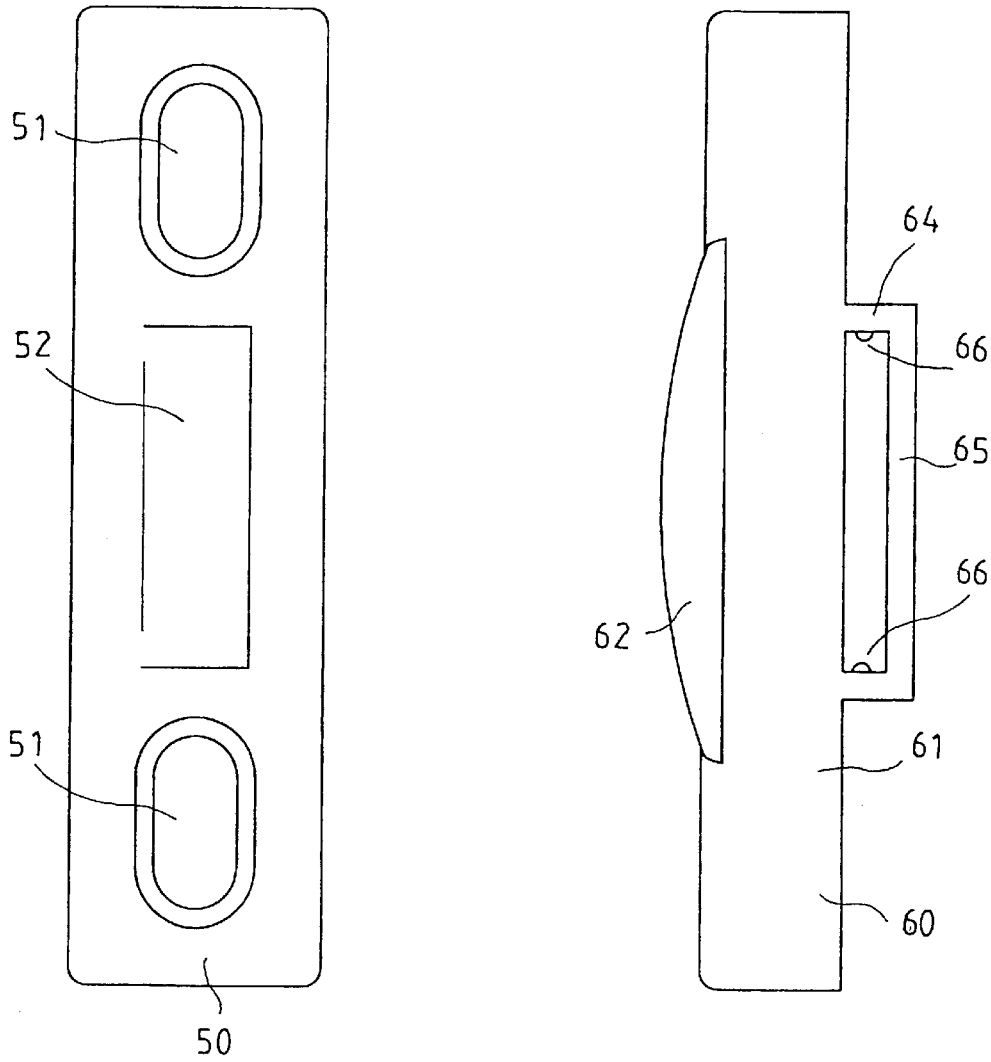
FIG. 6 shows an exploded view of a second preferred embodiment of the present invention.
Figure 7:
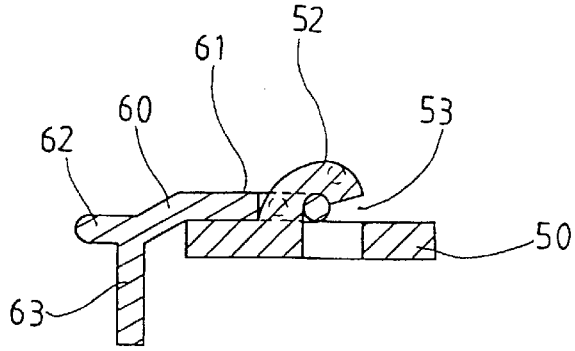
FIG. 7 shows a sectional schematic view of the second preferred embodiment of the present invention mounted on an adhesive tape dispenser.
Figure 8:
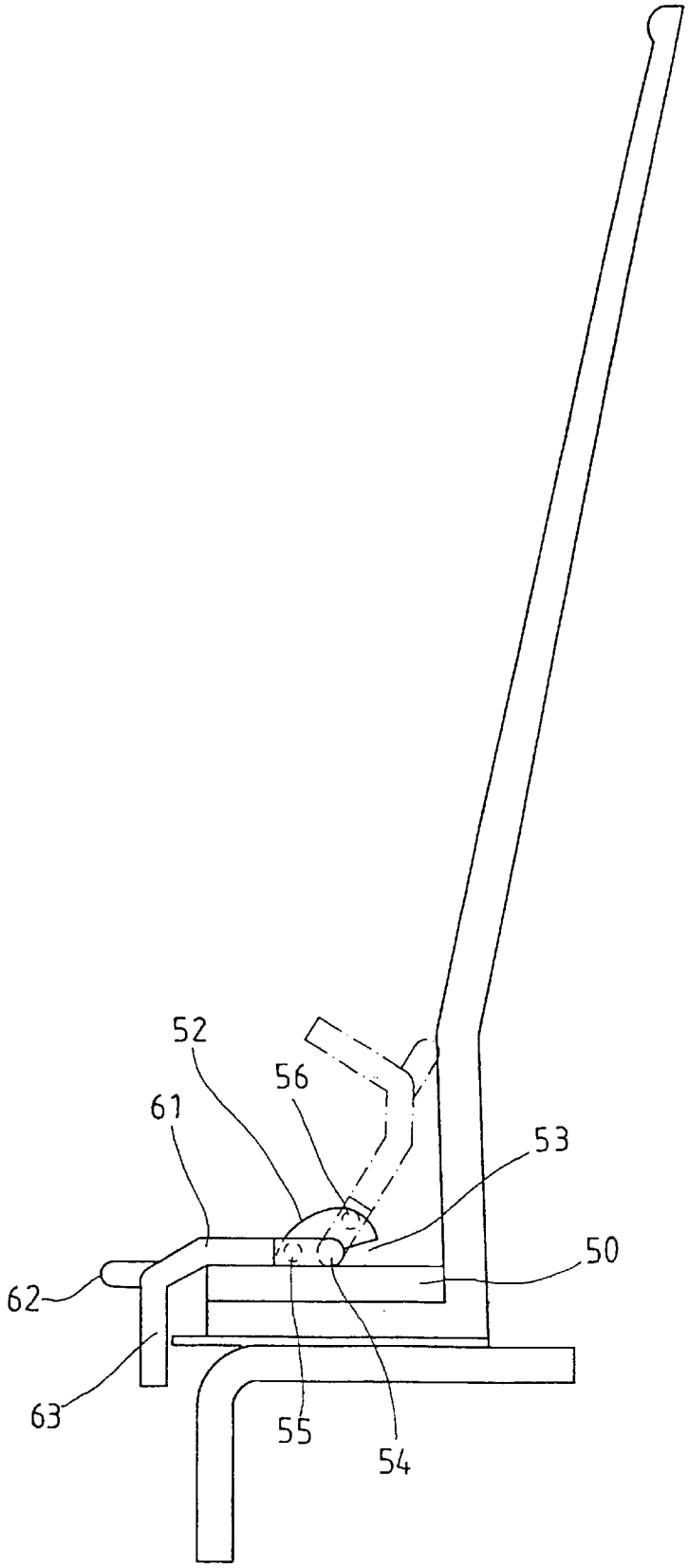
FIG. 8 shows a sectional view of the second preferred embodiment of the present invention.

As shown in FIGS. 6–8, the second preferred embodiment of the present invention comprises a carrying seat 50 and a cover 60.

The carrying seat 50 is provided with two long holes 51 extending along the direction of a longitudinal axis of the carrying seat 50. The carrying seat 50 is mounted over the cutter and the clapper of an adhesive tape dispenser by bolts which are received in the long holes 51. The carrying seat 50 is provided in the midsegment with a C-shaped retainer 52 extending therefrom such that one long side thereof is connected with the carrying seat, and that other long side thereof is provided with a retaining slot 53. The retainer 52 is provided with an axial hole 54 in communication with the retaining slot. The retainer is provided in two short sides with a locating portion located on the circumference of a circle with the axial hole as the center of the circle. These two locating portions are a first locating hole 55 and a second locating hole 56.

The cover 60 has a body 61 which is provided in one longitudinal side with an arcuate tongue 62, and a curved guard 63 extending therefrom at an angle, the body is further provided in other longitudinal side with two support arms 64 which are arranged at an interval slightly greater than the length of the retainer. The two support arms are connected at both ends thereof with a pivot 65 and are provided in two opposite inner sides thereof with a locating portion 66 projecting therefrom.

The cover is joined with the carrying seat such that the pivot 65 is retained in the retaining slot 53 of the carrying seat, and that the locating portions 66 of the two support arms 64 are located in the first locating hole 55. The carrying seat is then mounted over the cutter of an adhesive tape dispenser.

Figure 9:
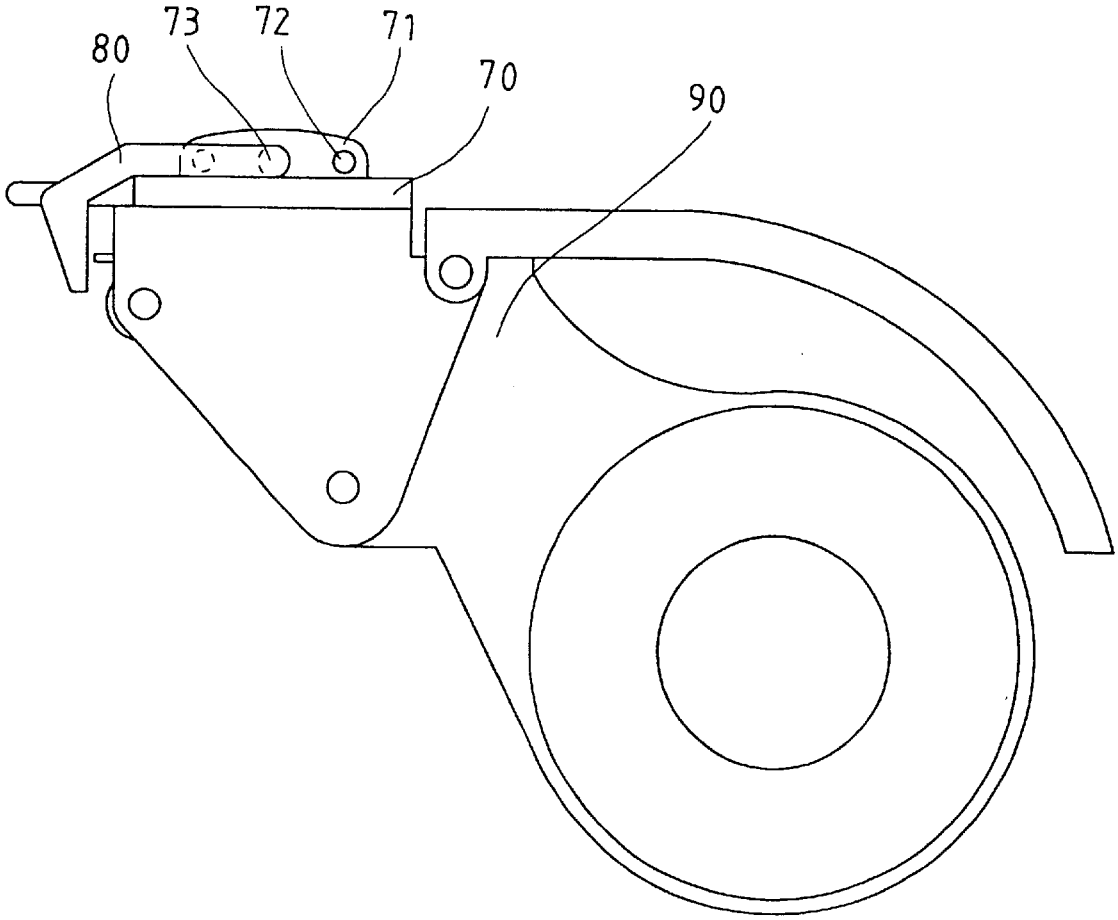
FIG. 9 shows a side schematic view of a third preferred embodiment of the present invention mounted on an adhesive tape dispenser devoid of a clapper.

As shown in FIG. 9, the third preferred embodiment of the present invention comprises a carrying seat 70 and a cover 80, which are intended to use along with an adhesive tape dispenser 90 devoid of the clapper. The two locating holes 72 of the upright plate 71 are located at both ends of the pivoting hole 73, thereby enabling the cover to rest against the top of the dispenser when the cover is lifted.

The present invention has advantages which are described hereinafter.

The cutter shields of the present invention are simple in construction and is compatible with various adhesive tape dispensers or stands.

The cover of the cutter shields of the present invention can be located with precision and ease and is therefore reliable.

The embodiments of the present invention described above are to be regarded in all respects as being merely illustrative and not restrictive. Accordingly, the present invention may be embodied in other specific forms without deviating from the spirit thereof. For example, the carrying seat and the cover of the present invention may be joined together in such a way that the upright plate is provided with a pivot which is received in an axial hole of the cover, and that the two upright plates may be disposed at both ends of the carrying seat instead of the midsegment of the carrying seat. The present invention is therefore to be limited only by the scopes of the following appended claims.

What is claimed is:

1. A cutter shield of an adhesive tape dispenser, said cutter shield comprising:

a carrying seat provided with holes for fastening said carrying seat over a cutter of the adhesive tape dispenser with bolts which are received in said holes;

a cover rotatably engaged to said carrying seat having a guard to shield a cutter of the adhesive tape dispenser, wherein the cover rotates between a first position covering the cutter and a second position where the cutter is uncovered, wherein the carrying seat has two upright plates which are spaced apart, each of the upright plates respectively having a first locating portion and a second locating portion, and a first pivoting portion;

wherein said cover has a flat portion, opposite ends of which each have a third locating portion and a second pivoting portion;

wherein said first pivoting portions and said second pivoting portions are respectively and rotatably engaged and said third locating portions respectively engage the first locating portions in the first position and the second locating portions in the second position.

2. The cutter shield as defined in claim 1, wherein the cover has two spaced apart recesses between which the flat portion extends out from the cover.

3. The cutter shield as defined in claim 2, wherein the cover has a body having a tongue, wherein the guard extends outward from the body at an angle.

4. The cutter shield as defined in claim 3, wherein the guard is curved.

5. The cutter shield as defined in claim 1, wherein the first pivoting portions are pivots and the second pivoting portions are axial holes.

6. The cutter shield as defined in claim 1, wherein the third locating portions are projections and the first locating portions and the second locating portions are each a locating hole.

7. A cutter shield of an adhesive tape dispenser, said cutter shield comprising:

a carrying seat provided with holes for fastening said carrying seat over a cutter of the adhesive tape dispenser,with bolts which are received in said holes;

a cover rotatably engaged to said carrying seat having a guard to shield a cutter of the adhesive tape dispenser, wherein the cover rotates between a first position covering the cutter and a second position where the cutter is uncovered, wherein said carrying seat is provided in a midsegment thereof with a retainer having an axial hole, the retainer being provided on opposite ends thereof with a first locating portion and a second locating portion located on the circumference of a circle with said axial hole being the center of the circle;

wherein said cover has a pivot rotatably engaged in said axial hole, said cover having two support arms which are fixed to opposite ends of the pivot and are each provided on an inner side thereof with a third locating portion;

wherein said third locating portions engage respectively the first locating portions in the first position and the second locating portions in the second position.

8. The cutter shield as defined in claim 7, wherein said first locating portions and said second locating portions are each a locating hole; and wherein said third locating portions are projections.

* * * * *